United States Patent [19]

Benhamou et al.

[11] Patent Number: 4,651,517

[45] Date of Patent: Mar. 24, 1987

[54] JEWELRY ROPE CHAIN

[75] Inventors: Guy S. Benhamou; Gianfranco A. Proia, both of Los Angeles, Calif.

[73] Assignee: Oroamerica, Inc., Burbank, Calif.

[21] Appl. No.: 766,057

[22] Filed: Aug. 15, 1985

[51] Int. Cl.[4] ..... B21L 5/02

[52] U.S. Cl. ..... 59/80; 59/16; 59/3; 59/20

[58] Field of Search ..... 59/1, 16, 20, 25, 35.1, 59/78, 83, 3, 80

[56] References Cited

U.S. PATENT DOCUMENTS

| | | | |
|---|---|---|---|
| 848,299 | 3/1907 | Feid | 59/35.1 |
| 944,640 | 12/1909 | Ungerer et al. | 59/1 |
| 979,110 | 12/1910 | Ungerer et al. | 59/16 |
| 1,053,726 | 2/1913 | Hamm et al. | 59/1 |
| 1,886,784 | 11/1932 | Boppenhausen | 59/78 |
| 4,493,183 | 1/1985 | Bucefari et al. | 59/16 |
| 4,503,664 | 3/1985 | Allazzetta et al. | 59/16 |

OTHER PUBLICATIONS

"Oroamerica", 'The Chain with the Heart', pp. 1–48, (no date).

*Primary Examiner*—R. L. Spruill
*Assistant Examiner*—David B. Jones
*Attorney, Agent, or Firm*—Drucker & Sommers

[57] ABSTRACT

The disclosure sets forth a different annular link as the building element; instead of using a split annular link of a 3:1 ratio of link inner diameter to major wire diameter, the link has substantially thinner annulus for forming the rope chain, an annulus that requires an over 5:1 ratio of inner annulus diameter to major wire diameter. The presently preferred ratio is between 5.2 and 5.7:1. It is possible to use even thinner annuluses, i.e. having greater ratios, e.g., 7.2–7.7:1 with even greater weight savings (approximately 35%), or other even greater odd-numbered ratios of inner annulus diameter to major wire diameter (e.g. 9.4–9.9:1). Thus, while there is no theoretical limit, there is probably a maximum practical upper limit to the ratio of inner annulus diameter to major wire diamater.

15 Claims, 25 Drawing Figures

Fig. 1
(PRIOR ART)
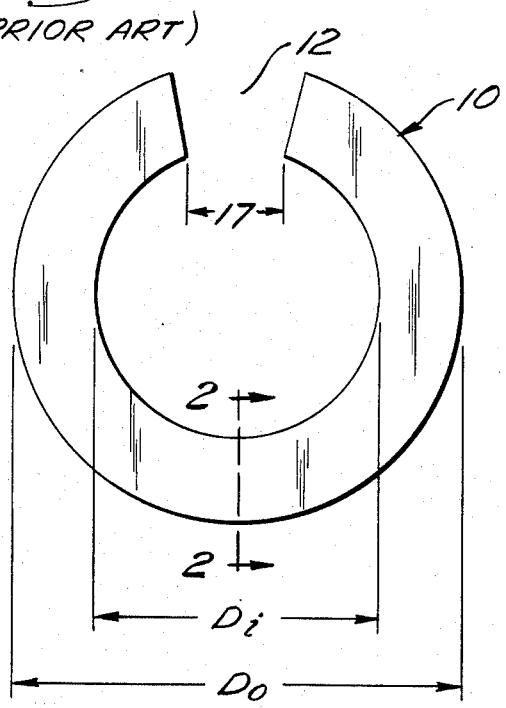
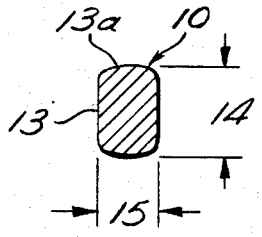
Fig. 2
(PRIOR ART)
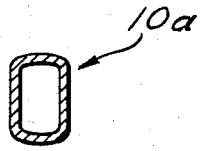
Fig. 3
(PRIOR ART)
Fig. 7
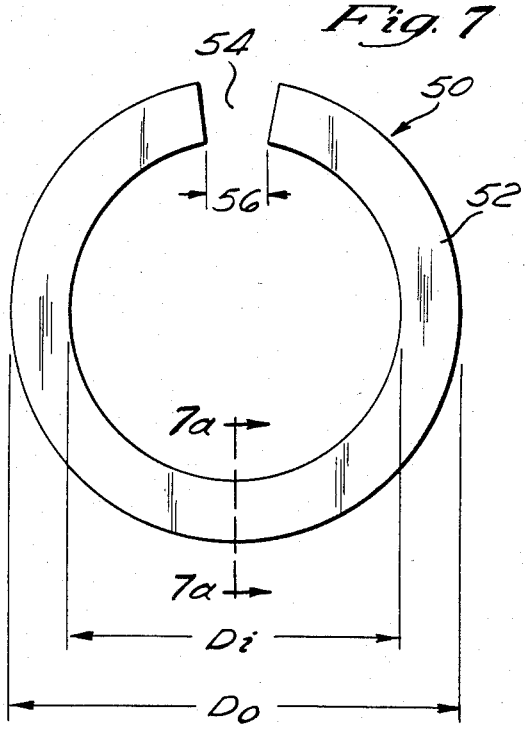
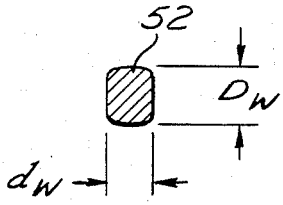
Fig. 7a

JEWELRY ROPE CHAIN

FIELD OF THE INVENTION

This invention relates to a novel construction for hand-made jewelry chain, popularly known as "rope" chain, and to the method of making such rope chain.

BACKGROUND OF THE INVENTION

Jewelry rope chain has, for decades, been made largely by hand, and will be first described. The basic construction element, or component, of rope chain of the prior art is an annular link formed of a solid wire, usually of precious metal, e.g., 14 karat gold. The annular link 10 is shown in FIGS. 1 and 2 of the drawings, and has an opening or gap 12 formed therein. The gap 12 has a narrowest dimension 17 at its inner diameter, and widens to its largest dimension at its outer diameter.

The solid wire forming the link 10 usually has flattened sides 13 and rounded ends 13*a* which give to the wire 10 a major diameter 14 and a minor wire diameter 15. The cross-section of the wire forming the link 10 may also be of generally circular cross-section. The opening 12 of link 10 is substantially larger than the minor wire diameter 15 and is slightly larger than the major diameter at its narrowest dimension 17.

The wire 10, while shown as a solid in FIGS. 1 and 2, may be hollow (See link 10*a* in FIGS. 3 and 4), but may otherwise be of the same configuration as FIGS. 1 and 2. The hollow wire link 10*a* obviously utilizes less gold than the solid wire link 10, but it is more costly to manufacture the hollow link 10*a* than a solid wire link 10.

The split wire links 10 (or 10*a*), in the prior art, are usually made from circular wire and the sides are flattened, and a multiplicity of such links are intertwined to form, in outward appearance, a double helix, as shown in FIG. 4, which double helix format is the standard rope chain 20 of the prior art. The standard rope chain of the prior art of FIG. 4 is made from the split wire links 10, as will now be described.

Each annular link 10 of the rope chain 20 has an inner diameter ($D_i$) that is slightly over three times the major wire diameter 14, e.g., 3.4X. The first link 10 forming the rope chain will be termed herein the A1 link, so designated because it is the first link in the first of a series of four links.

The relative orientation of the links 10 forming the rope chain is important. The A1 link is initially oriented (manually) so that its opening, designated 12*a*, lies in a predetermined direction, e.g., facing generally upwardly, as in FIG. 5*a*. The second link of the A series, designated the A2 link, is passed through the opening 12*a* of the A1 link, with the opening 12*b* of the A2 link facing downwardly at about 180° removed from the A1 link opening 12*a*, as shown in FIG. 5*b*. The A1 and A2 links are juxtaposed and intertwined so that they lay against each other, with the periphery of the A2 link lying against the periphery of the A1 link, to the greatest extent possible, thereby creating a relatively large central opening 30 within the pair of intertwined abutting annular A1, A2 links. The plane of the A1 link lies in parallel to the plane of the paper, and the plane of the A2 link is slightly skewed from the A1 plane.

The opening 12*c* of the third link, designated the A3 link, is then passed through the opening 12*b* of the A2 link and over the minor diameter of the A1 link and laid angularly against the A1 and A2 links, the opening 12*c* of the A3 link lying in the same orientation as the opening 12*a* of the A1 link, and as shown in FIG. 5*c*, but with its plane more greatly skewed than the A1 and A2 links. A central opening 30*a* still remains within the now three intertwined links A1, A2 and A3. The plane of each of the links differs from each other by perhaps about 20° because their abutment is angular.

Turning now to FIG. 5*d*, the opening 12*d* of a fourth link, A4, is now passed over the A1, A2 and A3 links, through the central opening 32*a*, and thereby envelopes the A1, A2 and A3 links. The A4 link is laid against the other links (A1–A3) and its plane lies approximately 20° from the plane of the A3 link. The opening 12*d* of the A4 link is disposed in the same orientation as the opening 12*b* of the A2 link.

All of the just-described manipulations are generally performed manually at the present time. As earlier mentioned, the openings 12*a*–12*d* of the annular links 10 are large enough to pass over the major and minor diameter of the wire forming the link. Further, the series of links just described, A1–A4, each having a $D_i$ of link slightly over three times the major wire diameter, permits the ready manual intertwining of links just described, especially the envelopment of the A4 link about the A1, A2 and A3 links.

The just-described intertwining and orientation of A1–A4 links permits the continuation of the intertwining of additional series of links (of four units each) to create a "double helix" rope chain 20 of a desired length. The adding on of an additional series of four links (designated herein as the B series) is a repetition of the orientation previously described with reference to the A1–A4 series, but the planes of the B series lie at approximately 90° to the planes of the respective links in the A series.

Thus, the next link of the B series, designated the B1 link, has its opening 12*e* passing through the A1–A4 links, and abutting a solid portion of the A1 link, as shown in FIG. 5*e*. It will be noted that the orientation of the B1 link is at approximately 90° to that of the A1 link, as shown in the cross-sectional view taken along line 6—6 of FIG. 5*e*. The respective openings 12A and 12*e* both face upwardly.

It is to be noted that, because of the slightly over three times $D_i$ of each annular link with respect to the major wire diameter, the B1 link can readily envelope the A2, A3 and A4 links and abut the solid portion of the A1 link.

The B2 link is then passed through downwardly facing opening 12*b* of the A2 link and oriented so that its opening 12*f* faces downwardly, and is further oriented to lie as flat as possible against the B1 link. The next link in the B series, the B3 link (not shown), will abut the solid portion of the A3 link, having its opening facing upwardly, and the B4 link will pass through the A4 opening (12*d*) and have the opening (of B4) facing downwardly.

The series of B links will lie in this general plane, i.e., at generally right angles to the first (A) series, and this type of right angle movement as the chain is built up results in a spiral having the appearance of the double helix, as shown in FIG. 4.

In the just-described build-up of annular links 10, it is to be noted that the openings of the first and third link additions abut the previous first and third links, and the second and fourth links pass through the openings of the previous second and fourth links. The openings of the previous second and fourth links were downwardly facing in the example shown in FIGS. 5*a*–5*f*, but could be differently oriented. However, the relative orientations of the links have, in the prior art, all been as just described. Insofar as the operator is concerned, he or she is always alternating an abutting connection (e.g., B1 abutting to A1 in the example) with the passing of a link through the second innermost hole of the link grouping (e.g., passing the B2 link through downwardly facing opening 12*b* of the A2 link).

After building up the links 10 in the manner just described, to form the double helix chain 20, the links are held in the desired juxtaposition temporarily by thin metal wire 22 wrapped about the links. Then solder S is intermittently applied, e.g., to every pair of adjacent links 10 at the external periphery thereof. The wire 22 is then removed. The intermittent soldering S (e.g., A2 to A3, and A4 to B1) results in a rope chain wherein every link pair is slightly movable, with respect to its adjacent link pairs, and results in a chain having the desired flexibility for forming a necklace or bracelet.

While the just described rope chain 20 of the prior art is extremely popular because of its appearance, it is costly to make, primarily because it utilizes a great deal of precious metal, such as 14 karat gold.

The applicants wish to also note the following prior art relating to the art of making rope chain, either manually or by machine, of which they are aware:

| Registration No. | Inventor |
|---|---|
| 848,299 | Feid |
| 979,110 | Ungerer |
| 1,053,726 | Hamm |
| 1,886,784 | Boppenhausen |
| 4,493,183 | Bucetari |
| 4,503,664 | Allazzetta |

It is a primary object of the present invention to substantially reduce the amount of precious metal required to make a rope chain (for equivalent width and length) vis-a-vis the prior art.

SUMMARY OF THE INVENTION

This invention utilizes a different annular link as the building element of the rope chain than does the prior art. Instead of using a split annular link of a 3:1 ratio of link inner diameter to major wire diameter, this invention utilizes a substantially thinner annulus for each link forming the rope chain, an annulus that requires an over 5:1 ratio of inner annulus diameter to major wire diameter. The presently preferred ratio is between 5.2 and 5.7:1.

The number of links to be intertwined in this invention increases, but the net savings in material, if the material is a precious metal, more than offsets the increased labor cost. An approximate weight saving of 20% results from using a 5.4:1 ratio of annular link. It is possible to use even thinner annuluses, i.e. having greater ratios, e.g., 7.2–7.7:1 with even greater weight savings (approximately 35%), or other even greater odd-numbered ratios of inner annulus diameter to major wire diameter (e.g. 9.4–9.9:1), but it becomes quite difficult to make such a rope chain manually. Thus, while there is no theoretical limit, there is probably a maximun practical upper limit to the ratio of inner annulus diameter to major wire diameter.

BRIEF DESCRIPTION OF THE FIGURES

FIG. 1 is a plan view of an annular link of the prior art;

FIG. 2 is a cross-section of the prior art wire forming the annular link, taken along the line 2—2;

FIG. 3 is a cross-section of another embodiment of prior art wire firming the annular link of FIG. 1;

FIG. 7 is a plan view of the annular link of this invention;

FIG. 7*a* is a cross-section of the wire forming the annular link taken along line 7*a*—7*a* of FIG. 7.

DETAILED DESCRIPTION OF THE INVENTION

Figure 4:
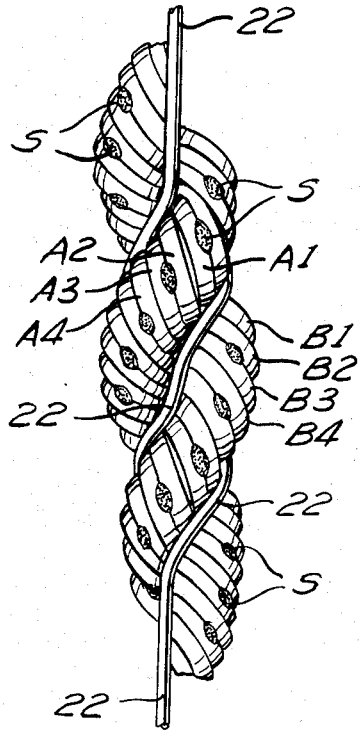
Fig. 4 (PRIOR ART)
FIG. 4 is a side elevation showing a section of finished rope chain of the prior art with forming wire not yet removed.

The annular link of this invention is shown in FIGS. 7 and 7*a* and is designated by the numeral 50. The ratio of the inner link diameter $D_i$ to the major wire diameter ($D_w$) is in excess of 5:1. This means that the wire 52 forming the annular loop 50 is thinner than the prior art annulus (FIGS. 1–3) and, as earlier mentioned, yields substantial weight savings, as will be shown. The annular link 50 is provided with an opening or gap 54, the opening 54 at its narrowest spacing 56 being just slightly larger than the $D_w$ of the wire 52.

In building the rope chain from the annular link of this invention, the basic series of units constitutes a series of six, eight, or more even number of links. Thus, with a 5+:1 ratio (e.g., 5.4:1) of annulus inner diameter to $D_w$, the basic building series of links 50 consist of repetitions of five intertwined links enveloped by the sixth; with a 7+:1 ratio (e.g., 7.7:1) of annulus inner diameter to $D_w$, the basic building series consist of a repetition of seven intertwined links enveloped by an eighth, and so on. The invention will be illustrated by an approximate 5.4:1 ratio of annulus inner diameter to $D_w$ in FIGS. 8*a*–8*g*.

Figure 8A:
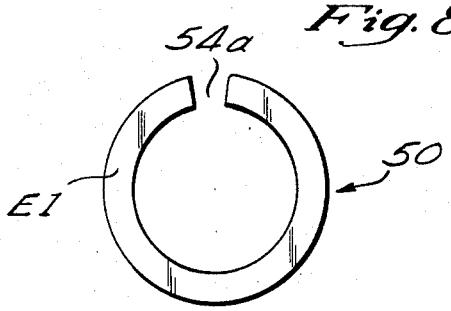
FIGS. 8*a*–8*g* show the build-up, in sequence and in perspective, of the rope chain of this invention.

The first link 50 in the series of the invention is designated E1. The E1 link is initially oriented, manually, so that its opening lies in a predetermined direction, e.g., facing upwardly, as shown in FIG. 8*a*. The second link of the series E2 is passed through the opening 54*a* of the E1 link, and positioned so that its opening 54*b* lies 180° removed from opening 54*a*. The E1 and E2 links are juxtaposed and intertwined so that they lay against each other with the periphery of the E2 link lying against the periphery of the E1 link to the greatest extent possible, thereby creating a relatively large central opening 60 within the pair of intertwined E1, E2 links.

Figure 5A:
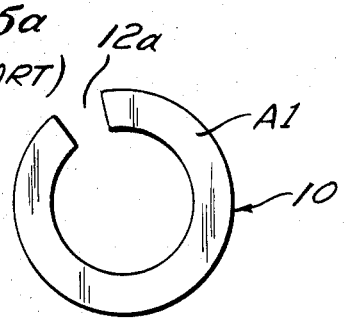
Fig. 5a (PRIOR ART)
FIGS. 5*a*–5*f* show, in sequence and in perspective, the build-up of prior art rope chain from prior art annular links.
Figure 5B:
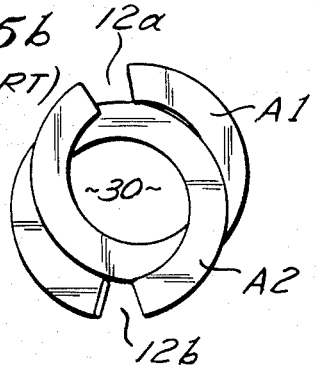
Fig. 5b (PRIOR ART)
Figure 8B:
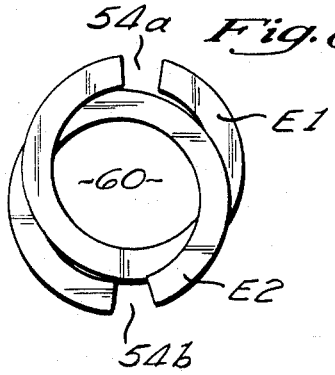
Figure 5C:
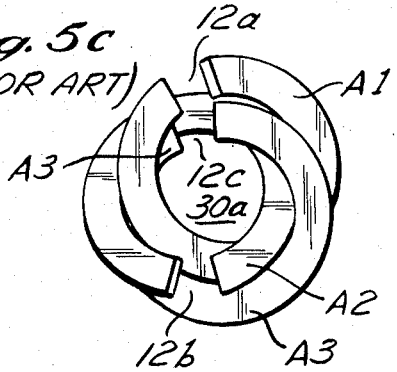
Fig. 5c (PRIOR ART)
Figure 8C:
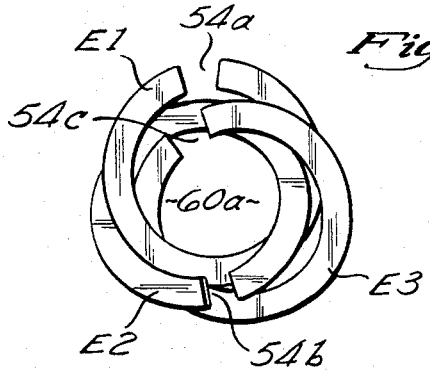
Figure 5D:
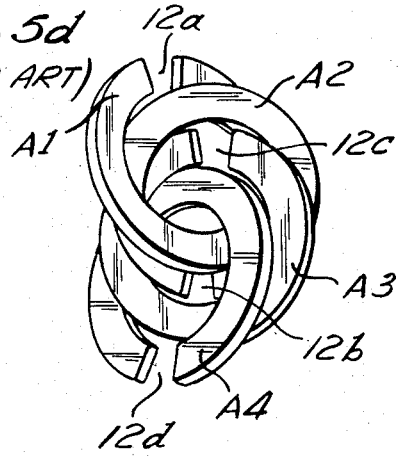
Fig. 5d (PRIOR ART)
Figure 8D:
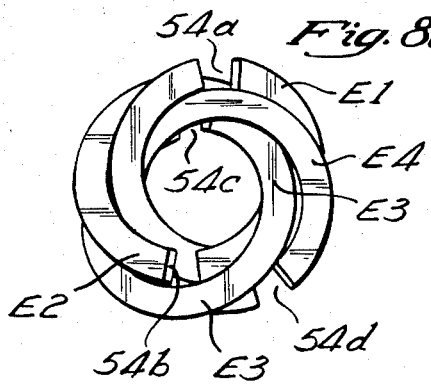
Figure 5E:
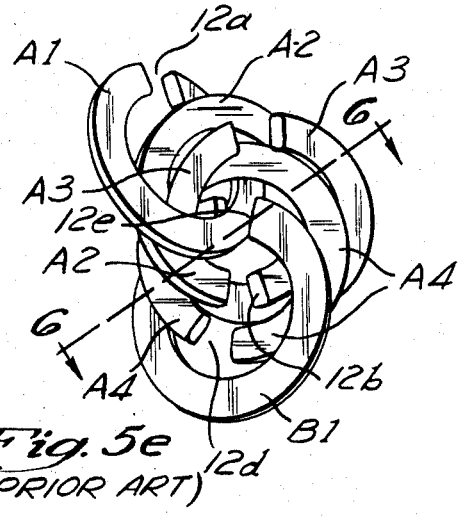
Fig. 5e (PRIOR ART)
Figure 8E:
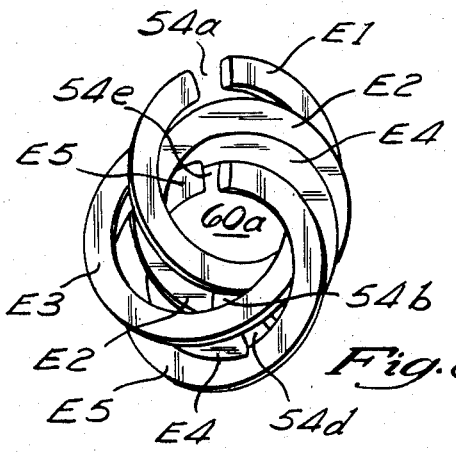
Figure 5F:
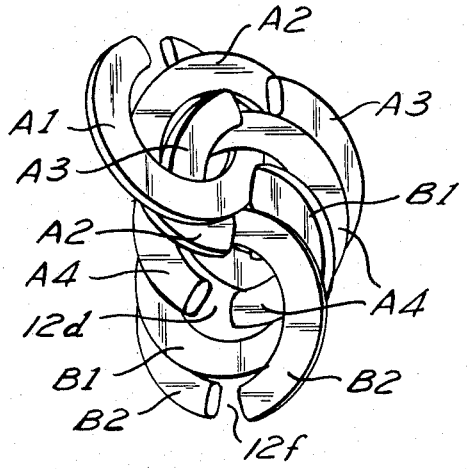
Fig. 5f (PRIOR ART)
Figure 8F:
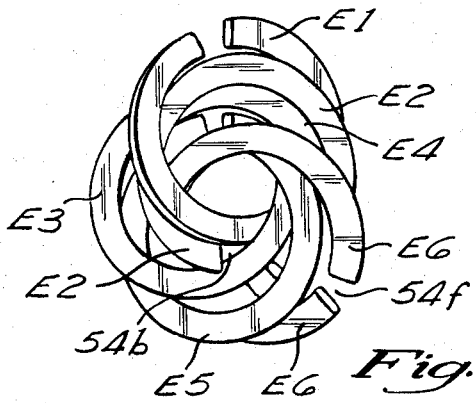

The opening 54c of the third link in the series, E3, is then passed through the opening 54b of the E2 link and over the minor diameter of the E1 link and laid angularly against the E1 and E2 links, the opening 54c of the E3 link lying in the same orientation as the opening 54a of the E1 link, and as shown in FIG. 8c. A central opening 60a still lies within the intertwined E1, E2 and E3 links. To this point, the E1, E2 and E3 links are intertwined, as were the A1, A2 and A3 links of the prior art (FIGS. 5a–5c). However, from this point forward, the invention requires that an E4 link be added to the three-link assembly, the E4 link being added by intertwining the E4 link with the other three links so that it lays in angular relationship to the other links. The E4 link is oriented so that its opening 54d faces downwardly, as is the E2 link. The E5 link continues the buildup and is intertwined, in the same fashion as described, with its opening 54e in the same orientation as opening 54a of the E1 link. The E1–E5 links all lie in planes of about 15° removed from each other. An E6 link is then passed through the central opening 60a remaining in the E1 to E5 series (FIG. 8f), the opening 54f facing downwardly. The E6 link is again about 15° angularly disposed with respect to the E5 link. The beginning of the spiral of the rope chain 100 will thus be seen to be formed.

Figure 8G:
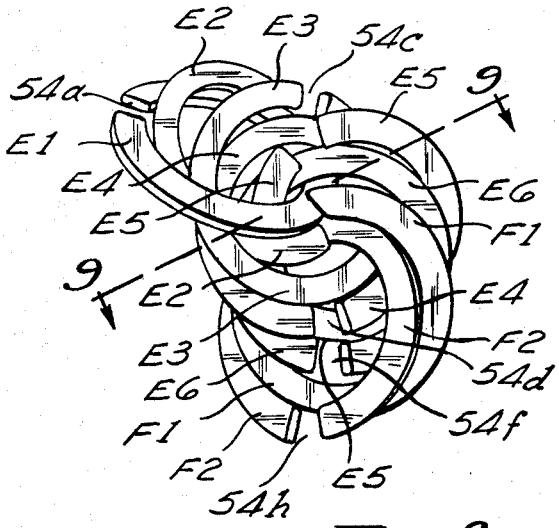
Figure 6:
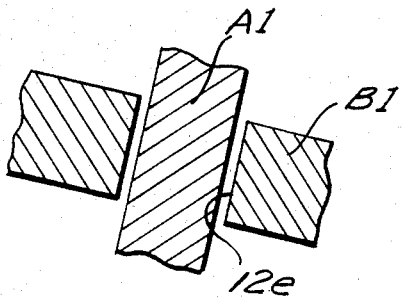
FIG. 6 is a cross-section taken along the line 6—6 of FIG. 5*e*.
Figure 9:
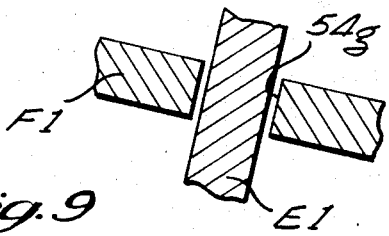
FIG. 9 is a cross-section taken along the line 9—9 of FIG. 8*g*.

The next series of links (The F series) is then commenced. The first link of the series F1 has an opening 54g, which is passed around links E2–E6 until the opening 54g lies in abutment with the bottom portion of link E1, as shown in FIGS. 8g and 9. The angular relationship of the E1 link to the F1 link is about 90°, the space between the E1 and F1 links being occupied by the five links E2–E6, angularly disposed with respect to each other, as earlier described.

The F2 link is then added by passing it through the third innermost opening 54b of E2. The F2 link has the same orientation as the E2 link, i.e., with its opening 54b facing downwardly.

Because of the 5+:1 ratio of the invention, the operator must always pass the additional links through the third innermost opening of the assembled links, as just described, rather than the second innermost hole, as in the prior art.

Figure 11:
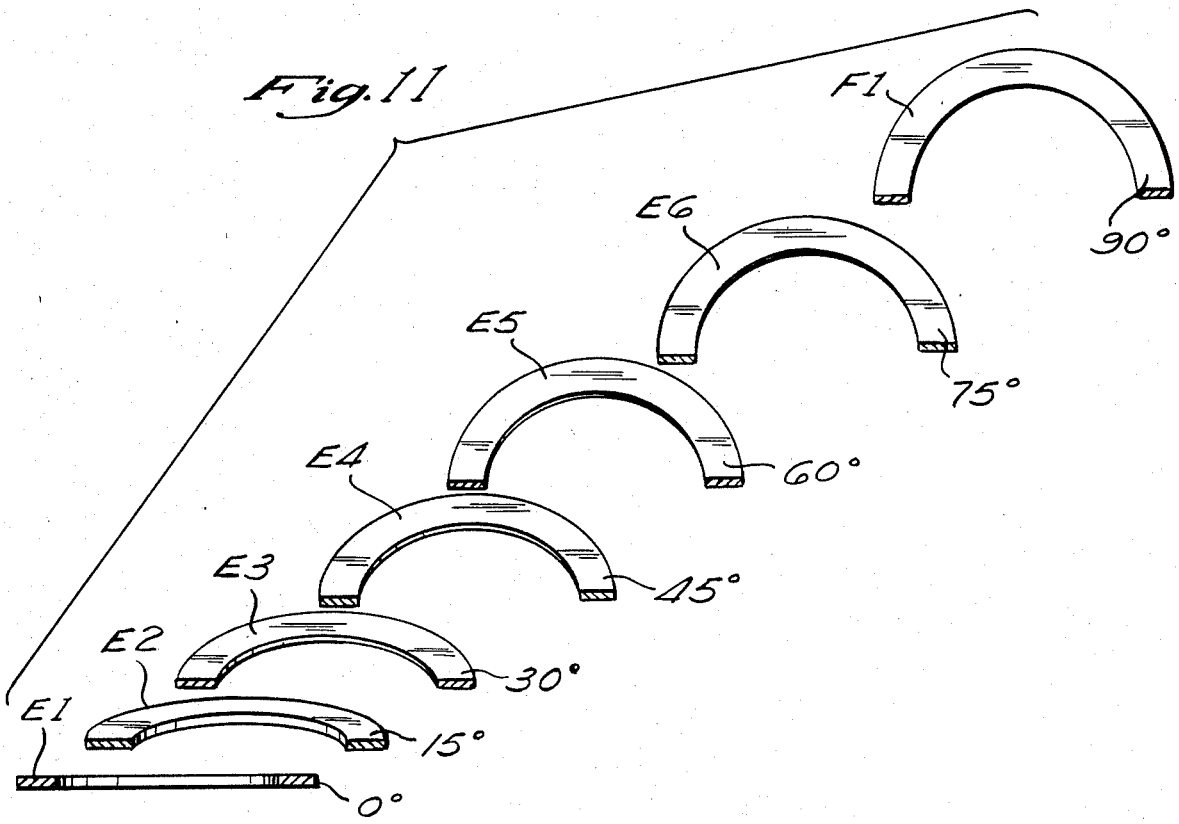
FIG. 11 is a schematic, exploded, cross-sectional view of one section of rope chain showing the build-up of links from the initial link (at 0°) to the initial link of the next series (at 90°)
Figure 12:
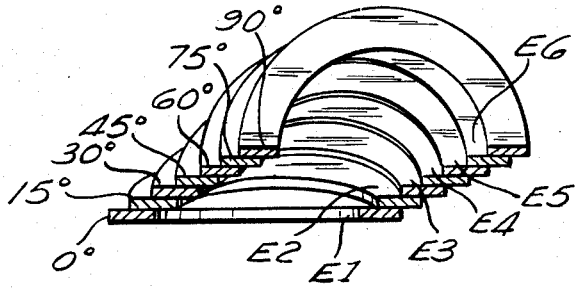
FIG. 12 is a schematic, assembled, cross-sectional view of the section of rope chain shown in FIG. 11.

The angular relationship between the links of the E series (E1–E6) and the next series is best shown in FIGS. 11 and 12, and note also FIGS. 8g and 9 wherein the 90° relationship between the E1 link and F1 link is also shown. In this way, the rope chain 100 is built up in a continuing spiral fashion. And, as the build-up of links in the F series continues, the F3–F6 links (not shown) will be added as follows:

F3—its opening will abut the lower portion of the E-3 link;

F4—will pass through the E4 link opening (54d) (the third innermost opening);

F5—its opening will abut the lower portion of the E4 link;

F6—will pass through the E6 link opening (54h).

The sequence of additional series of links will continue until the desired length of rope chain 100 is attained.

The rope chain 100 is then wrapped with thin wire (as shown in the FIG. 4 prior art), and then pairs of links are intermittently soldered at S, as in the prior art. By such intermittent soldering, the rope chain remains unitary but flexible—to be curvilinearly shaped into necklaces, bracelets, etc.

As an example of the weight saving over the prior art, the following example is set forth: Prior Art Chain:

Assume the prior art ratio of $D_i$ (inner diameter of link annulus) to $D_w$ (major wire diameter) = 3.42 and $D_0$ (outer diameter of link annulus) of prior art link 10 is 5.8 mm, and the wire is of generally circular cross-section. Then:

$$D_i/D_w = 3.42,$$

and $$D_o - D_i = 2D_w,$$

or $$5.8 - D_i = 2D_w,$$

and substituting for $D_i$ $$5.8 - 3.42\ D_w = 2D_w,$$

or $$5.8 = 5.42\ D_w,$$

and $$5.8/5.42 = D_w$$

$$1.07\ \text{mm} = D_w,$$

and $$D_i = 3.66\ \text{mm}$$

For every unit length of chain, 1, and density, d, per unit length 1 -- the weight $W_p$ of prior art chain is:

$$W_p = \left(\frac{D_o}{2}\right)^2 - \left(\frac{D_i}{2}\right)^2 dl$$

$$= dl\left(\frac{5.8}{2}\right)^2 - \left(\frac{3.66}{2}\right)^2$$

$$W_p = \frac{4.96}{} dl$$

The weight of the chain of this invention ($W_i$) is calculated as follows:

Assume a 5.43 ratio of $D_i$ to $D_w$ and that $D_w$ is of generally circular cross-section. $D_o$ is the same as before (5.8 mm), and the $D_w$ then equals 0.78 mm. Then $D_i$=4.24 mm.

$$W_i = \left(\frac{D_o}{2}\right)^2 - \left(\frac{D_i}{2}\right)^2 dl$$

$$W_i = 5.8\ dl$$

$$\frac{W_i}{W_p} = \frac{3.96}{4.96} \times 100 = 79.8\%$$

Thus, the rope chain will be 79.8% of the weight of the prior art chain for the same unit length and width (5.8 mm). The labor will be greater in that about 37% more links will have to be used, but if precious metal is used, e.g., 14 karat gold for the rope chain, the net savings will still be about 14% to 17% at the manufacturer level.

The weight savings will be even greater if a $7^{+}:1$ ratio of link inner diameter to wire diameter is employed as the basic building unit of the rope chain. This calculates out to approximately a 35% weight savings.

It is to be emphasized that the manufacture of rope chain has, for decades upon decades, been made on a slightly over 3:1 ratio (e.g., 3.2–3.7:1) of $D_i$ to $D_w$. To be able to achieve a weight savings of 20% to 35%, or better, of precious metal, is considered to be a breakthrough of great magnitude.

Figure 10:
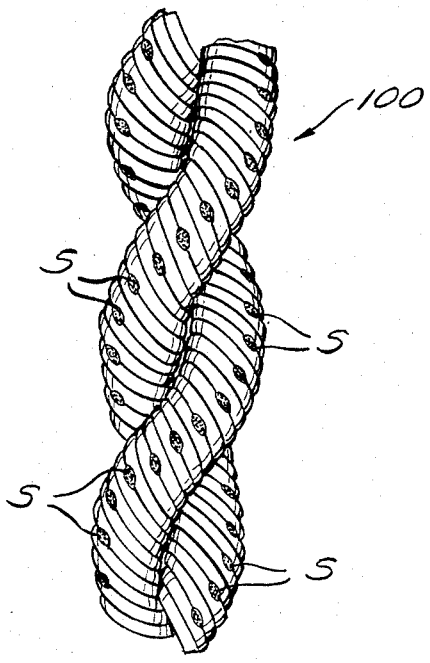
FIG. 10 is a side elevation showing a section of finished rope chain of this invention made along a "right-hand" weave.
Figure 13:
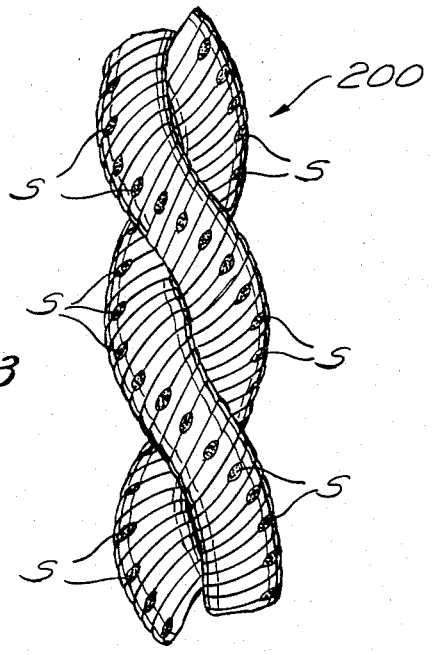
FIG. 13 is a side elevaton showing a section of finished rope chain of this invention made along a "left-hand" weave.

The invention has been illustrated as a right-hand weave, i.e. the finished spiral pattern (shown in FIG. 10) has the predominant direction of the exposed spiral as seen by the viewer of FIG. 10, moving from left to right, as viewed from the bottom up. The opposite weave, a left hand weave, is merely the mirror image of the right hand weave, and utilizes the identical annular links and method of manufacture except the link build up, and resulting spiral, proceeds from right to left, as viewed from the bottom up. See a section of finished rope chain 200, of left hand weave, shown in FIG. 13.

In summary, each of the annular links of our invention has an inner annulus diameter of at least five times greater than the major diameter of the wire forming the annulus. The wire may be circular in cross-section or may be slightly flattened to form a major and a minor diameter. The annular links are split to form a gap sufficiently wide to permit passage of one link through the gap of a like link. The wire is usually made of a precious metal such as 14 carat gold, other gold alloy, silver, or other precious or other metal or material.

The preferred ratio of inner annulus link diameter to wire major diameter is between about 5:1 to 5:5 and between about 7:1 to 7:6, although, theoretically, even higher basically odd numbered ratios can be utilized, e.g. 9:1:1. When the 5:1 to 5:5 ratio is employed, adjacent links are juxtaposed in about a 15° angular relationship, and when the 7:1–7:6 ratio is employed, the angular relationship is about 11° between immediately adjacent links.

We claim:

1. In a jewelry rope chain, having tightly interfitting links comprising annular links of wire of a given major diameter, each annular link having a small gap formed therein, said gap being slightly larger than the said given major diameter of the wire to permit one of said annular links to pass through the gap of a second of said annular links, the improvement wherein:

each of said annular links has an inner annulus diameter equal to just over X times greater than the said major diameter of the said wire forming each of said annular links, and X is an odd number greater than 3;

said rope chain is formed by a plurality of series of said annular links, each series comprising a number of said annular links equal to X, the first of said annular links in a series having its said gap oriented in a first given direction, a second immediately adjacent annular link passing through the gap of said first annular link and angularly intertwined and laid adjacent thereto, said second annular link being oriented so that its said gap is about 180° removed from the orientation of said first gap, successive odd numbered annular links being oriented in a similar direction as said first annular link and intertwined with a previously intertwined annular link, successive even-numbered annular links being oriented in a similar direction to said second annular link and intertwined with a previously intertwined annular link, to complete each said series; and in every series of intertwined annular links an annular link of a next series, envelopes the previous series of X annular links, to form said jewelry rope chain having tightly interfitting links.

2. The jewelry rope chain of claim 1 wherein:

the said wire of said annular links are circular in cross-section.

3. The jewelry rope chain of claim 1 wherein:

the said wire of said annular links are generally circular in cross-section, but flattened along two sides thereof, to form a given major diameter and a given minor diameter.

4. The jewelry rope chain of claim 1 wherein:

the said wire of said annular links are made of a precious metal selected from gold, a gold alloy, silver, and a silver alloy.

5. The jewelry rope chain of claim 1 wherein:

the said wire of said annular links are made of 14 carat gold.

6. The jewelry rope chain of claim 1 wherein:

the said wire of said annular links are made of a solid metal.

7. The jewelry rope chain of claim 1 wherein:

the said wire of said annular links are made of a metal having a hollow core.

8. The jewelry rope chain of claim 7 wherein:

the said wire of said annular links are made of a precious metal selected from gold, a gold alloy, silver, and a silver alloy.

9. The jewelry rope chain of claim 7 wherein:

the said wire of said annular links are made of 14 carat gold.

10. The jewelry rope chain of claim 1 wherein:

each of said annular links has an inner annulas diameter equal to between about 5.1 to about 5.5 times the said major diameter of the said wire forming said annular links.

11. The jewelry rope chain of claim 1 wherein:

each of said annular links has an inner annulus diameter equal to between abut 7.1 and 7.6 times the said major diameter of said wire forming said annular links.

12. The jewelry rope of claim 1 wherein:

X equals 5, and wherein, in every series of five intertwined annular links comprising first through fifth annular links, a sixth annular link of a next series, forming said jewelry rope chain envelopes the first five annular links, each of said first five intertwined links lies at an approximately 15° angle to each other, and the said sixth annular link lies at approximately 90° to the said first annular link forming the chain whereby to form a continuing spiral structure for said rope chain.

13. The jewelry rope chain of claim 1 wherein:

X equals 7 and wherein, in every series of seven annular links comprising first through seventh annular links, an eighth annular link of a next series envelopes the first seven annular links, each of said first seven links lies at an approximately 11° angles to each other, and the said eighth annular link lies at approximately 90° to the said first annular link forming the chain whereby to form a continuing spiral structure for said rope chain.

14. The jewelry rope chain of claims 1, 3, 4, 6, 10, 11, 12, or 13 wherein:

the chain comprises a right hand weaving pattern.

15. The jewelry rope chain of any of claims 1, 3, 4, 6, 10, 11, 13, or 14 wherein:

the chain comprises a left hand weaving pattern.

* * * * *